United States Patent [19]

Yates et al.

[11] 4,375,192

[45] Mar. 1, 1983

[54] PROGRAMMABLE FUZE

[75] Inventors: Patrick A. Yates, China Lake; Richard M. Swenson; George N. Hennings, both of Ridgecrest, all of Calif.

[73] Assignee: The United States of America as represented by the Secretary of the Navy, Washington, D.C.

[21] Appl. No.: 250,978

[22] Filed: Apr. 3, 1981

[51] Int. Cl.[3] ..... F42C 11/06

[52] U.S. Cl. ..... 102/215

[58] Field of Search ..... 102/206, 215, 265, 266, 102/270, 271

[56] References Cited

U.S. PATENT DOCUMENTS

| | | | |
|---|---|---|---|
| 2,801,588 | 8/1957 | Filbert, Jr. | 102/70.2 |
| 3,717,098 | 2/1973 | Davis et al. | 102/70.2 R |
| 3,750,583 | 8/1973 | White et al. | 102/70.2 R |
| 4,019,440 | 4/1977 | Strike | 102/70.2 R |
| 4,063,513 | 12/1977 | Kadish et al. | 102/206 |
| 4,089,268 | 5/1978 | Jaroska et al. | 102/70.2 R |
| 4,096,802 | 6/1978 | Waln | 102/49.5 |

*Primary Examiner*—Charles T. Jordan

*Attorney, Agent, or Firm*—R. F. Beers; W. T. Skeer

[57] ABSTRACT

A programmable fuze for initiating weapon warhead detonation. The deacceleration of the weapon warhead is measured by an accelerometer. The output of the accelerometer is integrated to obtain velocity and subsequently digitized and stored in a microcomputer or microprocessor. A zero-slope detector indicates to the microcomputer or microprocessor if the forward velocity component is constant for a given time. This indicates whether the weapon warhead has entered a cavity in the target. The microcomputer or microprocessor has an algorithm programmed into it so that it determines whether certain dynamic variables have exceeded threshold values thus initiating a detonating signal to a firing circuit. The dynamic variables are the distance of travel of the weapon warhead into the target, the deceleration level of the weapon warhead in the target, the transverse velocity component of the weapon warhead in the target, and the number of cavities entered. These four dynamic variables are compared to threshold values such as distance, breakup level, ricochet, and cavity entered. If any one of the given dynamic variables equals or exceeds a given threshold value, the microprocessor signals the detonation of the warhead.

6 Claims, 2 Drawing Figures

PROGRAMMABLE FUZE

BACKGROUND OF THE INVENTION

1. Field of the Invention

The present invention relates to a fuze for controlling the detonation of a warhead as it enters a target.

More particularly, the invention relates to a programmable fuze adapted to initiate warhead detonation after the warhead has penetrated the target to a predetermined optimal burst point.

The programmable fuze has dynamic motion sensing means whose outputs are converted to digital information which are input into a microcomputer or microprocessor. The programmable fuze has the capability of: (1) detecting depth of penetration into the target; (2) counting the number of cavities perforated; and (3) impending warhead breadup or ricochet so that a burst point is selected by the microcomputer based on calculated penetration parameters after preset threshold values are exceeded.

2. Description of the Prior Art

One type of device is a fixed delay fuze which has a delay mechanism physically built into the fuze mechanism and can be varied, if at all, only before the weapon is launched. The delay time can be varied typically from 2 milliseconds to 125 milliseconds. Extensive and costly tests are required to determine the penetration capability of this type of warhead, but even when this information has been determined, target resistance is not always known or available and penetration trajectory within the target can vary widely.

Another type of fuze uses breakup sensors to detonate the weapon before breakup renders the weapon ineffective.

Still another type of fuze uses electromechanical means for detonating the warhead when the deceleration of the warhead falls to a predetermined value after impact with the target.

These three devices may or may not cause the detonation of the warhead to correspond to an optimum penetration distance into the target.

In order to maximize the damage caused by the warhead explosion, target parameters such as size, density, the attack angle of the weapon carrying the warhead, and configuration must be taken into consideration.

SUMMARY OF THE INVENTION

The present invention relates to a programmable fuze for a weapon warhead which is designed to initiate detonation upon penetration of a target a preselected distance or after a preselected number of cavities have been perforated by the warhead. This is the primary mode of operation. Other, default or salvage, modes are based upon breakup of the warhead, or ricochet. Deceleration of the weapon after impact with the target is detected by an accelerometer. The deceleration signals are integrated to obtain a velocity signal. The analog velocity signal is then converted to digital form and then transmitted to a data memory of the microcomputer. Another feature of this invention is the zero slope detector which receives the forward velocity component signal. If the forward velocity component is constant for a given period of time, the zero slope detector outputs a signal indicating the traversal of a cavity within the target. This information is input to the microcomputer.

The microcomputer performs mathematical operations on the velocity component data to determine the impact environment variables. An algorithm programmed into the microcomputer performs various operations to determine if distance, breakup, ricochet or cavity entry threshold values have been met or exceeded to trigger detonation.

One object of this invention is a fuze which causes detonation based upon a plurality of factors such as breakup, ricochet, distance travelled, or number of cavities traversed.

Another object of the invention is a programmable fuze which optimizes the detonation of the warhead in the target based upon deceleration information.

DESCRIPTION OF THE PREFERRED EMBODIMENT

Figure 1:
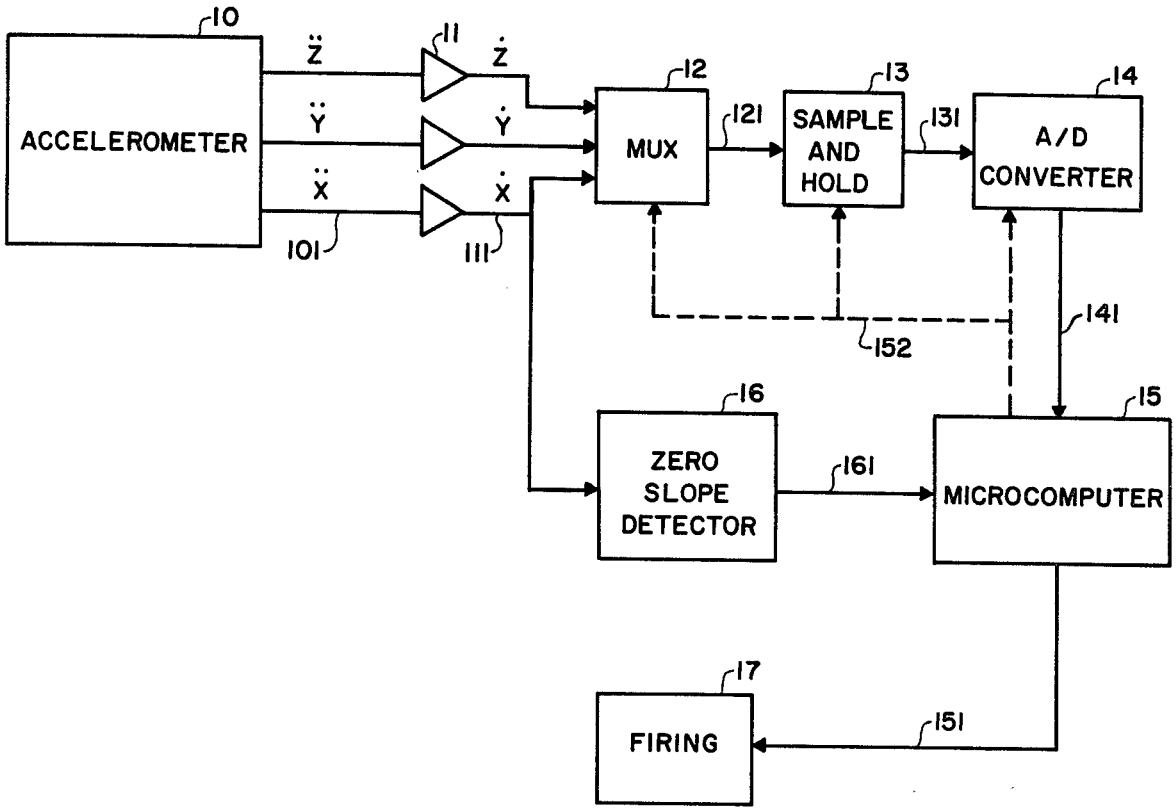
FIG. 1 is a block diagram of the programmable fuze.

Referring to FIG. 1, this illustrates the programmable fuze. A triaxial accelerometer 10 measures the deceleration of the weapon as it enters the target. Accelerometer 10 outputs three deceleration signals 101. $\ddot{X}$ is the deceleration measured relative to the logitudinal axis of the weapon. $\ddot{Y}$ and $\ddot{Z}$ are the decelerations measured transversely to the longitudinal axis of the weapon and are measured 90° from each other. Each deceleration signal 101 is input into an operational amplifier 11 which integrates deceleration signal 101. Operational amplifiers 11 output changing velocity component signals 111 representing X, $\dot{Y}$, $\dot{Z}$; velocity component signals 111 are input into a multiplexer 12 which sequentially outputs $\dot{X}$, $\dot{Y}$, and $\dot{Z}$, upon receiving a timing signal 152 from a microcomputer 15. A multiplexed velocity component signal 121 is input into a sample and hold circuit 13. Sample and hold circuit 13 looks at multiplexed velocity component signal 121 for a fraction of the timing signal period, and thereafter outputs an average velocity component signal 131 to an analog-to-digital converter 14. Analog-to-digital converter 14 looks at averaged velocity component signal 131, which is still analog but constant, and converts this to a digital format. Analog-to-digital converter 14 outputs a velocity component data signal 141 to microcomputer 15.

$\dot{X}$ velocity component signal 111 is also input into a zero slope detector 16. Zero slope detector 16 outputs a zero slope signal 161 which indicates that there is a discontinuity in density of the target material, i.e., a cavity in the target.

A data word in the data memory of microcomputer 15 can have four fields of information. The first field is velocity component information, the second field is the time, the third field is the source such as X component, Y component, or Z component, and the fourth field is the zero slope information which is only received on X axis signals. Microcomputer 15, having an algorithm stored within a read only memory, operates on the data field to determine if threshold values have been exceeded and if so, transmits a detonate signal 151 to firing circuit 17 to detonate the warhead of the weapon.

There are many state-of-the-art devices that may be used to implement this system. The microcomputer, for example, may be one of the single chip microcomputers in the Intel 8748 family. The digitizer portion of the system may be selected from those known in the art to have a sample rate conversion time of between 1 microsecond and 10 microseconds depending on the fuze application and the duration of penetration. The analog integrators may be conventional state-of-the-art op-amps and could possibly be included as part of the accelerometer package where economic conditions involved in production warrant such a combination of elements.

In greater detail, the programmable fuze initiates detonation upon the occurence of one of four possible conditions. The first condition is breakup of the warhead; the second condition is ricochet of the warhead; the third condition is the penetration of a predetermined distance into the target; and the fourth condition is the perforation of a predetermined number of cavities.

The deceleration of the weapon is translated by accelerometer 10 into deceleration signals 101. Deceleration signals 101 are integrated by operational amplifiers 11 which in turn output velocity component signals 111. The operational amplifiers not only integrate deceleration signals 101 but effectively filter high frequencies that would cause sampling errors when the signal is being digitized. These high frequency signals are the result of the weapon body "ringing" after it hits the target. This ringing is transmitted through the accelerometer and can result in error signals.

The $\dot{X}$ velocity component signal is routed in two directions, into the digitizer that converts this signal from an analog to a digital signal, and into zero slope detector 16 that identifies whenever $\dot{X}$ velocity component signal is constant for a determined period of time.

The $\dot{Y}$ and $\dot{Z}$ velocity component signals are also converted from analog to digital format in the digitizer. The digitizer is composed of sample and hold circuit 13 and an analog-to-digital converter 14. Before the velocity component signals are digitized, the particular velocity component signal is selected by multiplexer 12. This selection is controlled by timing signal 152 from microcomputer 15. Sample and hold circuit 13 takes multiplexed velocity component signal 121 and outputs an average velocity component signal 131 to the analog-to-digital converter 14. Analog-to-digital converter 14 sequentially outputs three velocity component data signals to microcomputer 15.

Figure 2:
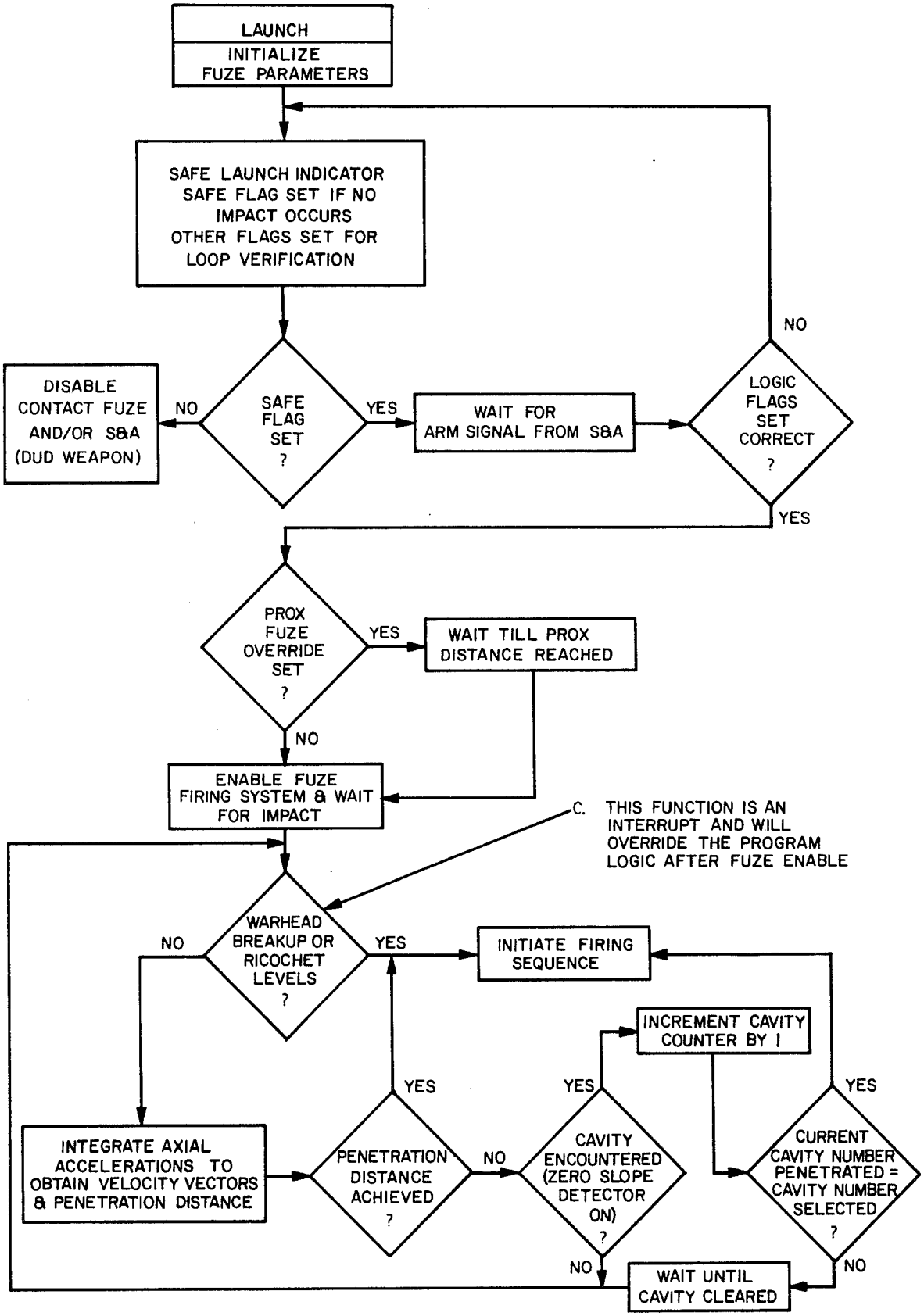
FIG. 2 is a logic diagram of the programmable fuze joined to launch, safing, and arming logic.

Referring to FIG. 2, the programmable fuze logic is shown in conjunction with prior fuze logic.

Upon launch of the weapon, fuze parameters are initialized in the programmable fuze.

To prevent hazards from dud weapons, a safe launch indicator sets a flag if no impacts occur within 200 or so milliseconds after the launch signal. If the flag is not set, the fuze is disabled and/or the safing and arming circuit (S&A) fails to arm the firing system. If the safe flag is set, the arming sequence continues in a normal manner. After a given interval of time and a given sequence of events, the safing and arming circuit outputs an arming signal. Logic flags are further verified and if properly set, the proximity fuze override is checked. If the proximity fuze override is set, the weapon must reach a given range from the target before the fuze is enabled. This prevents detonation from enemy round hits that might appear as a true target to the logic. Otherwise, the fuze is enabled directly.

As noted above, the programmable fuze has four threshold functions. Initially, the weapon may breakup or ricochet off the target. To maximize damage in this case, the warhead must be detonated immediately by starting the firing sequence.

The breakup function is performed by differentiating the $\dot{X}$ velocity component data. This is performed by microcomputer 15. If the value of the deceleration has exceeded a breakup level, a given negative g, microprocessor 15 sends a detonate signal 151 to firing circuit 17 to detonate the warhead; if the deceleration level is below the threshold level, no detonate signal 151 is transmitted.

To determine whether the ricochet threshold has been crossed, microcomputer 15 compares the $\dot{Y}$ and $\dot{Z}$ velocity component data to preset levels; if exceeded or equalled, microcomputer 15 sends a detonate signal 151 to firing circuit 17.

If neither the breakup or ricochet levels have been exceeded, the programmable fuze determines the penetration distance by integrating $\dot{X}$ velocity component data to obtain the distance travelled since target impact. The initial velocity is estimated and placed in microcomputer 15 for this determination. If the distance threshold has been crossed, microcomputer 15 signals the warhead to detonate; if the distance threshold has not been crossed, microcomputer 15 continues to compute the distance travelled.

The cavity perforated function is activated when zero slope detector 16 senses a constant $\dot{X}$ velocity component signal 111 for a given length of time. As each cavity is entered, the cavity counter in microcomputer 15 increments and compares the present number to the cavity number selected and if equal, microcomputer 15 signals the warhead to detonate; if not, no detonate signal is sent. Then, microcomputer 15 sequences to evaluate the breakup or ricochet function since a new wall must be entered. The above sequence repeats in a given order until one threshold is crossed.

Obviously, many modifications and variations of the present invention are possible in light of the above teachings and it is therefore understood that, within the scope of the disclosed inventive concept, the invention may be practiced otherwise than specifically described.

What is claimed is:

1. A programmable fuze for initiating a warhead detonation upon a crossing of one of four threshold values comprising:

means for sensing deceleration of the warhead after impact and outputting deceleration signals;

means for integrating the deceleration signals and outputting velocity component signals;

means for sequentially transmitting one multiplexed velocity component signal;

means for digitizing the multiplexed velocity component signal and outputting a velocity component data signal;

a zero-slope detector for determining the occurence of a constant velocity and outputting a zero-slope signal indicating a change in target density;

means for processing, controlling and outputting a detonation signal; and a firing means for receiving the detonation signal and for initiating the detonation of the warhead.

2. The programmable fuze according to claim 1, wherein said means for sensing deceleration is a triaxial accelerometer.

3. The programmable fuze according to claim 1, wherein said means for digitizing comprises a sample and hold circuit and an analog-to-digital converter.

4. The programmable fuze according to claim 1, wherein said processing means comprises a microcomputer or microprocessor for processing the velocity component data signals and the zero-slope signals, for controlling the flow of analog and digital velocity component signals, and for determining the values of certain variables and whether threshold values are equalled or exceeded by the variables.

5. The programmable fuze according to claim 4, wherein the variables determined are a distance of travel into the target by the weapon, a deceleration level of the weapon, a transverse velocity component for ricochet, and a cavity entered.

6. A method for initiating the detonation of a weapon warhead during or after penetration of a target if any one given threshold value is equalled or exceeded comprising the steps of:

determining whether a distance of travel of the warhead has equalled or exceeded a given threshold distance;

determining whether the deceleration of the warhead after impact has equalled or exceeded a threshold breakup level;

determining whether a transverse velocity component has equalled or exceeded a threshold value indicating ricochet of the weapon;

determining whether a cavity is entered and if the number of entered cavities has equalled or exceeded a threshold cavity number; and detonating the warhead if any one of given the variables has equalled or exceeded threshold values.

* * * * *